United States Patent [19]

Novoselac et al.

[11] 4,392,846

[45] Jul. 12, 1983

[54] CENTRIFUGE APPARATUS

[75] Inventors: John Novoselac, Aurora, Colo.; Dale L. Churcher, Johannesburg, South Africa

[73] Assignee: Joy Manufacturing Company, Pittsburgh, Pa.

[21] Appl. No.: 264,389

[22] Filed: May 18, 1981

[51] Int. Cl.[3] ..... B04B 1/10

[52] U.S. Cl. ..... 494/40; 494/56

[58] Field of Search ..... 233/20 R, 20 A, 46, 233/47 R, 47 A, 19 R, 19 A; 494/2, 3, 4, 40, 56

[56] References Cited

U.S. PATENT DOCUMENTS

| | | | |
|---|---|---|---|
| 1,100,872 | 6/1914 | Hall . | |
| 1,101,548 | 6/1914 | Hoffman . | |
| 1,328,084 | 1/1920 | Hackett . | |
| 1,585,393 | 5/1926 | Laughlin . | |
| 1,613,579 | 1/1927 | Hinchley . | |
| 2,023,762 | 12/1935 | Fawcett | 233/20 A |
| 2,087,727 | 7/1937 | Bath . | |
| 2,136,127 | 11/1938 | Fawcett | 233/20 A |
| 2,178,547 | 11/1939 | Bjornstjerna . | |
| 2,378,778 | 6/1945 | Lindgren . | |
| 2,394,015 | 2/1946 | Schutte . | |
| 2,578,456 | 12/1951 | Smith . | |
| 2,733,856 | 2/1956 | Kjellgren . | |
| 2,750,040 | 6/1956 | Strich . | |
| 2,821,340 | 1/1958 | Wijngaarden . | |
| 2,878,995 | 3/1959 | Pega . | |
| 3,081,027 | 3/1963 | Coulson . | |
| 3,085,742 | 4/1963 | Palmovist . | |
| 3,087,645 | 4/1963 | Eddy . | |
| 3,119,775 | 1/1964 | Wilsmann . | |
| 3,179,334 | 4/1965 | Sharples . | |
| 3,233,535 | 2/1966 | Fowlie . | |
| 3,273,790 | 9/1966 | Dahlberg . | |
| 3,281,068 | 10/1966 | Baram . | |
| 3,297,243 | 1/1967 | Hein . | |
| 3,297,244 | 1/1967 | Hein . | |
| 3,347,456 | 10/1967 | Kobbernagel . | |
| 3,408,001 | 10/1968 | Nilsson . | |
| 3,410,481 | 11/1968 | Dahlberg . | |
| 3,494,544 | 2/1970 | Thylefors . | |
| 3,532,265 | 10/1970 | Baram . | |
| 3,535,158 | 10/1970 | McBride . | |
| 3,582,934 | 6/1971 | Zumhulsen . | |
| 3,593,915 | 7/1971 | Steinacker . | |
| 3,599,861 | 8/1971 | Demartial . | |
| 3,623,657 | 11/1971 | Trump . | |
| 3,666,170 | 5/1972 | Calliabue . | |
| 3,750,940 | 8/1973 | Nilsson . | |
| 3,774,840 | 11/1973 | Boatright . | |
| 3,777,952 | 12/1973 | Kjellgren . | |
| 3,799,431 | 3/1974 | Lavanchy . | |
| 3,823,868 | 7/1974 | Baram . | |
| 3,825,177 | 7/1974 | Kohlstette . | |
| 3,854,657 | 12/1974 | Pause . | |
| 3,863,838 | 2/1975 | Pronk . | |
| 3,871,575 | 3/1975 | Niemeyer . | |

*Primary Examiner*—Robert W. Jenkins

*Attorney, Agent, or Firm*—William J. O'Rourke, Jr.

[57] ABSTRACT

A centrifuge apparatus having an external movable member to close the outer end of a fixed width peripheral discharge opening which may be partially deformable to effect such closing.

7 Claims, 3 Drawing Figures

CENTRIFUGE APPARATUS

This application is to an improvement in controlling the discharge of a centrifuged mixture from a centrifuge apparatus of a type as shown in U.S. patent application Ser. No. 905,695, filed May 15, 1978.

DESCRIPTION OF THE PRIOR ART

Centrifugal separators or centrifuges are commonly used in various industries with one type of centrifuge generally comprising a pair of formed bowl members normally rotatable about a vertical axis and having a discharge opening extending continuously throughout the outer periphery of the bowl members, i.e. a peripheral discharge. U.S. Pat. No. 3,823,869 utilizes a flexible portion or portions of the centrifuge to provide for the closing of the centrifuge discharge opening or, alternatively an external indexing plate. Flexible centrifical bowl members are not suited for high material volume discharge and indexible plates do not provide for a continuous peripheral discharge. U.S. Pat. No. 1,585,393 shows a peripheral discharge centrifuge in which the pressure of the centrifuged material overcomes a bias to force the bowl members apart to provide for material discharge. Such a structure is impractical since the force required to overcome the biasing force cannot be maintained constant. U.S. Pat. No. 3,281,068 shows a peripheral discharge centrifuge with a fixed width discharge opening which is opened and closed by a sealing body intermediate the length of the slot. Such structure is expensive to provide and maintain since it is internal of the centrifuge. U.S. Pat. No. 3,823,868 shows a hydrostatically operated piston for moving a portion forming the discharge opening. Such structure is also difficult to maintain and the discharge opening forming portion creates an obstruction to material discharge. U.S. patent application Ser. No. 905,695 shows such a centrifuge in which the discharge opening is formed by movement of an entire annular segment of one of the bowl members. Although such a structure has proven to be satisfactory, it is quite expensive and requires substantial maintenance to ensure proper operation.

BRIEF DESCRIPTION OF THE INVENTION

The instant invention provides an external selectively operable member, such as a hydraulic cylinder, carried by one bowl member of a centrifuge having a peripheral discharge opening in conjunction with another bowl member and which selectively operable member is independently operable to locate an encompassing external ring member or section to open and close the outer end of a fixed width discharge opening without regard to any pressure created by the centrifuged material. In such structure the radial extent of the discharge opening, other than the outer end, is unobstructed by the ring member or section. The entire mechanism for controlling the discharge opening is external of and operates independently of the centrifuge to facilitate its installation, adjustment and repair. Alternatively the ring member or section can be of a form to form one side of the discharge opening to vary the angle of the material discharge path and may be deformable to provide a resilient seal of the discharge opening.

Accordingly, one object of this invention is to provide an external selectively operable member independent of the centrifuge to control the discharge of centrifuged material from the outer end of a peripheral discharge opening.

Another object of this invention is to provide an external selectively operable member independent of the centrifuge to control the discharge of centrifuged material from the outer end of a peripheral discharge opening which includes a deformable member to resiliently seal the outer end of the discharge opening.

Another object of this invention is to provide a closure member having a replaceable section forming one side of a peripheral discharge opening of a centrifuge which section is deformable to selectively open and close the outer end of the discharge opening.

These and other objects of this invention will be better understood upon consideration of the following detailed description of presently preferred embodiments thereof taken in conjunction with the following drawings, wherein.

Figure 1:
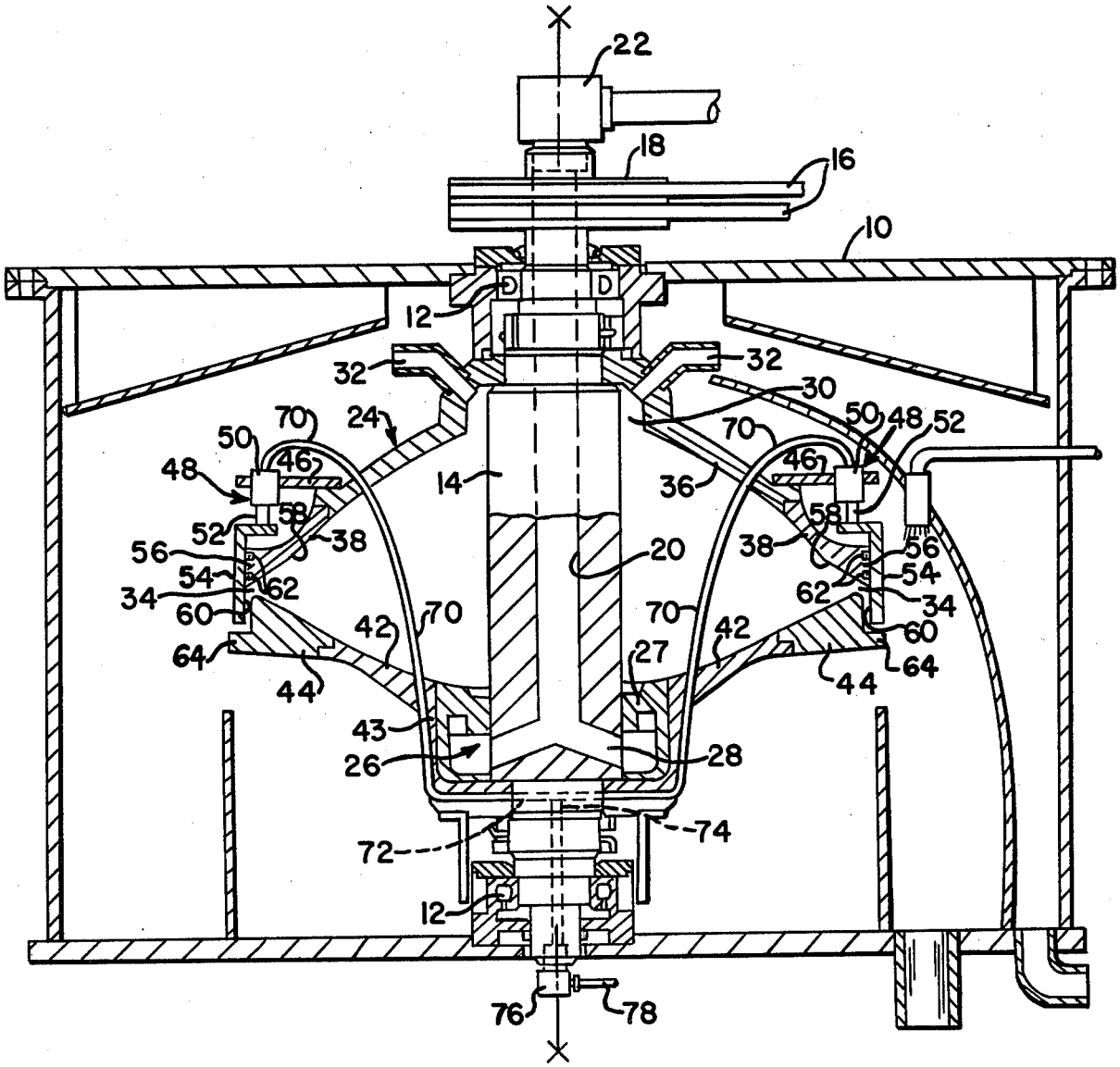
FIG. 1 is a cross sectional view of a centrifuge constructed in accordance with the principles of this invention with portions thereof being in side elevation.

The present invention is to structures for controlling the discharge of centrifuged material from a bowl centrifuge and is illustrated in FIG. 1 as incorporated in the centrifuge of U.S. patent application Ser. No. 905,695 which application is incorporated herein for a more complete illustration and description of a bowl centrifuge having a peripheral discharge opening.

The rotary bowl centrifuge of FIG. 1 comprises a stationary formed housing 10 having vertically spaced and aligned bearings 12 for supporting an elongated shaft 14 for rotation about its vertical rotation axis X—X. In the description herein the terms radial and circumferential are with reference to the rotation axis X—X, the term axial is with reference to the rotation axis X—X or any axis parallel thereto, and the terms upper, lower, inner and outer and the like are used for convenience in this description with respect to the showing of the figures herein. Shaft 14 is suitably rotationally driven by means of a controllable motor (not shown) having drive belts 16 cooperable with a pulley 18 rigidly secured to the shaft 14 upwardly adjacent the housing 10. Shaft 14 is provided with a central vertically extending passageway 20 therein with the upper end being open and cooperable with a feed pipe assembly 22 to supply the material, i.e. the slurry, to be separated in the centrifuge. A separation chamber or bowl 24, comprising formed upper and lower members, is suitably rigidly secured to shaft 14 to rotate therewith within housing 10. The lowermost portion of the bowl 24 has a distributor-accelerator member 26 which member 26 has an interior passageway in open communication with ports 28 extending laterally and downwardly from the inner end of passageway 20. Member 26 has an upper passageway 27 in communication with the interior of bowl 24. Bowl 24 has an uppermost central annular chamber 30 encompassing the upper portion of the shaft 14 with circumferentially spaced discharge ports 32 extending upwardly and outwardly of the chamber 30 and in open fluid communication therewith. Material is discharged from the bowl 24 through ports 32 with the flow thereof being suitably directed within housing 10 by suitable means.

In operation the incoming slurry to be subjected to the centrifugal action of the centrifuge is introduced through the feed pipe assembly 22 and thereafter flows through passageway 20, ports 28, member 26, passageway 27 into bowl 24 in which the mixture is separated with the low density fraction thereof being discharged through the ports 32 and with the high density fraction or centrifuged material thereof being discharged through a peripheral discharge opening 34 between the outer peripheral portions of bowl 24.

The upper member of bowl 24 has a generally inverted conical disc portion 36 which extends outwardly and downwardly from the portion thereof forming chamber 30. A formed ring member 38 is suitably removably and rigidly secured to the outer end of the disc portion 36 and has an inner surface of a form to provide a smooth continuation of the inner curvature of disc portion 36. The lower member of bowl 24 also has a generally conical disc portion 42 which extends outwardly and upwardly from a lowermost cup-shaped portion thereof which cup-shaped portion receives the distributor-accelerator member 26 therein. A formed ring member 44 is suitably removably and rigidly secured to the outer end of the disc portion 42, and has an inner surface of a form to provide a smooth continuation of the inner curvature of disc portion 42.

A circular mounting plate 46 is suitably removably and rigidly secured (not shown) to the exterior of disc portion 36 to extend outwardly therefrom and spaced above the outer end of ring member 38. A plurality of circumferentially spaced openings are provided within place 46 for receiving actuators 48 therein respectively which actuators 48 are shown in a different scale to better illustrate their structure. Actuators 48 are of a known structure such as hydraulic or pneumatic cylinders each comprising a stationary housing 50 and a movable piston 66 with rod 52 attached thereto. Housings 50 are rigidly secured to plate 46 in any suitable manner (not shown) such that the rods 52 extend downwardly therefrom and are selectively movable in an axial direction. The lowermost portions of rods 52 are suitably removably and rigidly secured (not shown) to a circular closure member 54 of an inverted L-shaped cross section which encompasses the outer end portion 56 of ring member 38. Rods 52 are secured to the short leg portion of closure member 54 with member 54 being spaced above the outer end portion 56 a sufficient distance so as not to interfere with the herein described axial movement of member 54. The outer end portion 56 of ring member 38 has an interior surface 58 which flares outwardly from the upper portion of ring member 38 at a transitional angle to permit centrifuged material to flow in an unobstructed manner thereover as is more fully described in copending Ser. No. 905,695, filed May 15, 1978. The outer end surface of ring member 38 extends axially upwardly from the outer end of surface 58 to form a cylindrical surface which is in sliding engagement with the axially inwardly facing surface 60 of the long leg of the member 54. In order to provide a sealing engagement between end portion 56 and the long leg of member 54, end portion 56 is provided with a pair of outwardly open circumferential grooves which have circular O-rings 62 located therein in a known manner. The outermost end of ring member 44 is located inwardly of the outer end of end portion 56 to permit unobstructed axial movement of the closure member 54. In addition, ring member 44 has a circumferential outwardly extending circumferential lip 64 which provides a seat or stop for the lower end of closure member 54.

Each piston 66 is biased in an axially upwardly direction by means of a spring 68 which encompasses the upper portion of rod 52 and extends between the lower surface of the piston 66 and the upper inner surface of the housing 50. Actuators 48 are simultaneously energized to simultaneously move the closure members 54 downwardly into engagement with the upper surface of lip 64 and close the discharge opening 34 between the bowl members. In order to obtain such movement of piston 66 each housing 50 has a fluid supply line 70 suitably connected to the upper end thereof which line 70 extends along the outer surface of the bowl members into registry with the respective open ends of circumferentially spaced passageways 72 in the lower end of shaft 14. Passageways 72 extend radially inwardly from the exterior of shaft 14 to a central passageway 74 extending coaxially downwardly within shaft 14 with the lowermost end of passageway 74 being in registry with a suitable fluid flow control 76 having a suitable controllable fluid supply line 78 connected thereto. Control 76 is of any suitable type to permit the flow of fluid to be controlled as described herein and suitable known fittings, not shown, are utilized between the described portions of the fluid supply system. As is known a swivel joint is provided between the rotating line and the stationary line and the control is located at a suitable remote location.

In operation the discharge opening 34 is normally maintained in the open condition since the springs 66 bias the closure member 54 into its uppermost position. Such normal positioning of the closure member 54 is desired to permit continuous discharge of centrifuged material over long periods of time without requiring the supply of control fluid to the actuators 48. At any time desired during the operation of the centrifuge, control fluid can be supplied to the actuators 48 to close the discharge opening 34 or, if the opening 34 is closed, to open the opening 34 by discontinuing the supply of control fluid.

Figure 2:
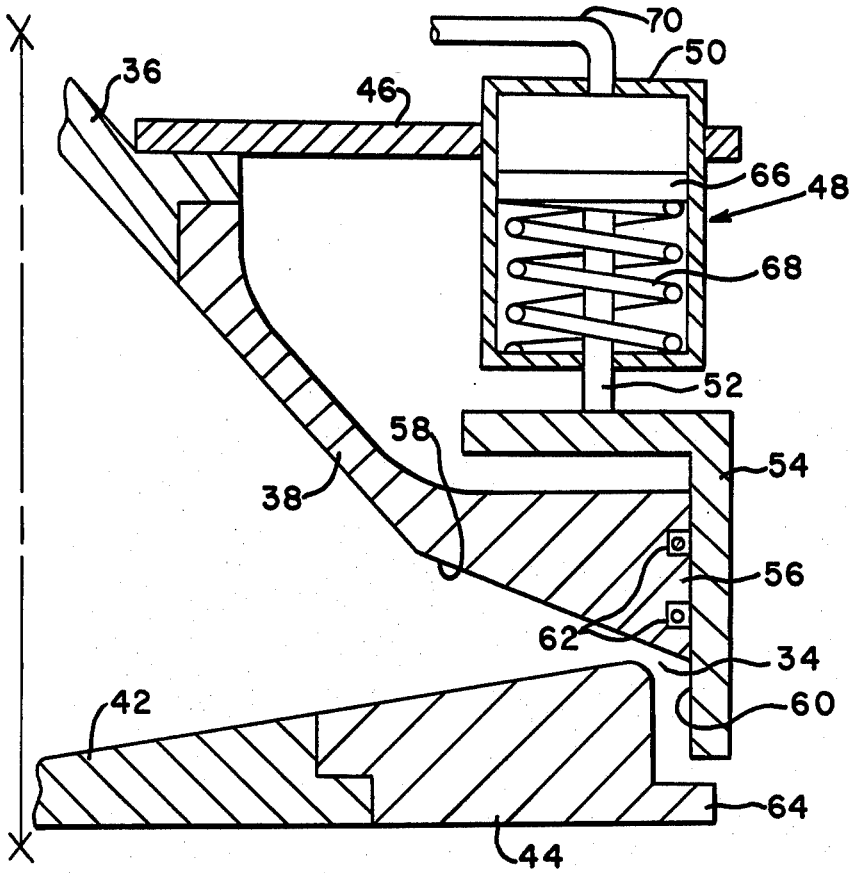
FIG. 2 is an enlarged cross sectional view of the outer peripheral material discharge portion of the centrifuge as shown in FIG. 1.

The closure member 54 is shown in FIGS. 1 and 2 in an open position such that the centrifuged material discharge is impeded by the radially inner surface of the long leg of member 54. With such construction the centrifuged material is discharged through the peripheral opening 34 against the radially inner surface of member 54 and flows axially downwardly between the outer surface of ring member 44 and the inner surface of member 54 to the final material discharge opening between the upper annular surface of lip 64 and the lower annular surface on the end of member 54. Such impeding of centrifuged material flow is desired to provide the required degree of material discharge flow since the rate at which material is discharged varies depending upon the characteristics of the centrifuged material. The length of the passageway between ring member 44 and member 54 can be varied as selected by varying the uppermost position of member 54 by varying the bias of spring 68 or by varying the pressure of the actuating fluid. Alternatively the impedance to material flow by member 54 can be eliminated by locating member 54 above the discharge opening 34 when member 54 is in its uppermost position as may be desirable when the flow characteristics of the centrifuged material remain relatively constant. In the event the member 54 is not to provide any impedance to material discharge flow, the radially outermost cylindrical surface of ring member 44 can be in axial alignment with the outermost cylindrical surface of end portion 56 so that the long leg of member 54 simultaneously slidably engages both the outer cylindrical surfaces of ring member 44 and end portion 56 to close the discharge opening 34. Also, in such event the outer end of ring member 44 can be provided with suitable grooves to receive O-rings 62 therein to provide a seal with the lower portion of the long leg of member 54.

Figure 3:
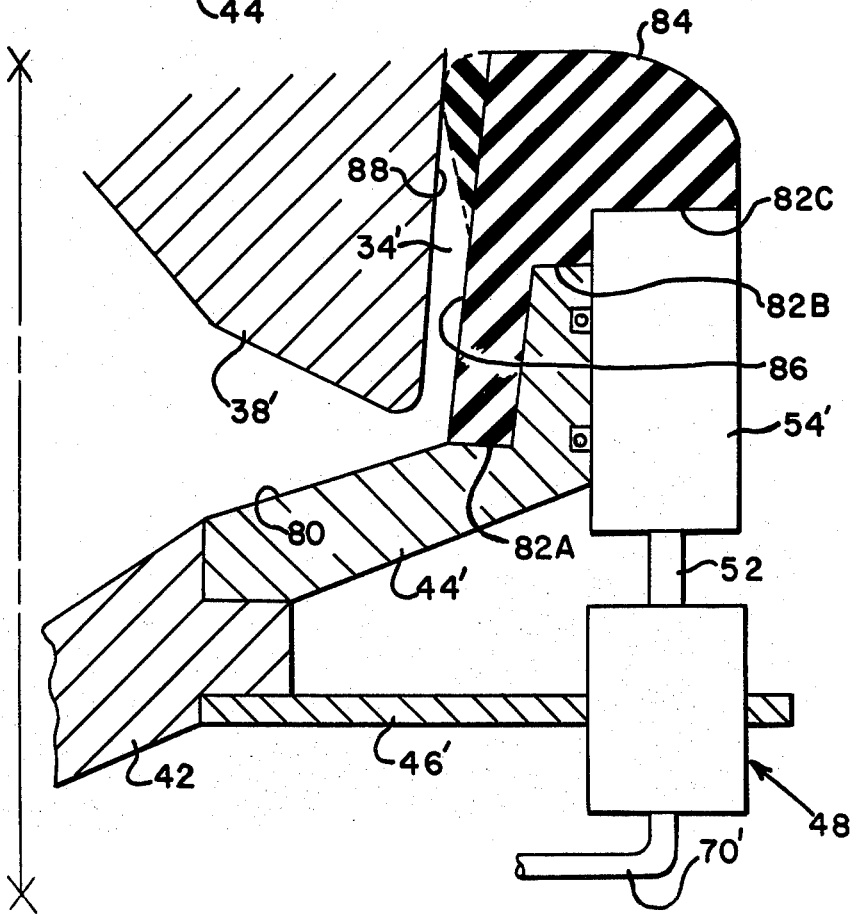
FIG. 3 is a cross sectional view similar to FIG. 2 illustrating another embodiment of a peripheral discharge portion of a centrifuge constructed in accordance with this invention.

The structure shown in FIG. 3 illustrates various modifications that can be made to the material discharge zone of the centrifuge previously described to control the discharge of centrifuged material. In this embodiment certain numerals used with reference to FIG. 2 are primed with reference to FIG. 3 to indicate that the structures have similar functions. The same numerals were used with reference to FIGS. 2 and 3 to indicate like structures although, if desired, obvious modifications may be made thereto. As shown, a formed ring member 44' is suitably removably and rigidly secured to the outer periphery of the disc portion 42. Ring member 44' has an upper surface 80 which extends outwardly and upwardly at a selected angle with respect to the inner surface of disc portion 42 to obtain the desired material flow thereover. The outer end of ring member 44' has a cylindrical outer surface which extends upwardly above surface 80 and which cylindrical surface has axially spaced grooves therein for receiving resilient O-rings 62 therein to provide a sealing engagement for an axially movable closure member 54'.

Member 54' is a ring member having its lower end suitably secured (not shown) to the rod 52 of an actuator 58 as previously described. A circular plate 46' is suitably removably and rigidly secured (not shown) to disc portion 42 and extends radially outwardly therefrom to rigidly support the housings 50 of a plurality of circumferentially spaced actuators 48 as previously described. Actuators 48 are inverted with respect to those described with relation to FIG. 2 such that the springs 68 bias the member 54' axially downwardly to maintain the material discharge opening 34' normally open. A suitable supply line 70' is connected to each actuator 48 which lines 70' are connected to passageways 72 to permit the actuators 48 to be selectively actuated as desired and as previously described.

The upper end of member 54' extends above the upper end of the outer end portion of ring member 44' whereby a stepped arrangement of lands 82A, 82B and 82C are provided for receiving a formed resilient ring section 84 of the closure member. Ring section 84, in cross section, comprises an elongated lower formed portion and an upper laterally enlarged portion whereby the ring section 84 is flexible intermediate its length upon movement of the member 54' as hereinafter described. Ring section 84 is formed from any suitable resilient material having excellent resiling characteristics to permit flexure without substantial deterioration over long periods of operation. Ring section 84 has formed seat areas thereon which engage the lands 82A, B and C respectively such that the ring section 84 is properly supported to obtain the herein described operation of ring section 84. Thus, land 82A is provided at the juncture of surface 80 with the outer upstanding portion of ring member 44', land 82B is provided at the outer upper end of ring member 44' and land 82C is provided on the upper end of the member 54'. Ring section 84 is suitably removably and rigidly secured to the outer end portion of ring member 44' and lands 82A and 82B such as by being bonded thereto. If desired, ring section 84 can also be bonded to the upper end of closure member 54'. Preferably, ring section 84 is secured to ring member 44' by suitable mechanical fasteners to permit replacement of ring section 84 such as may be desired when abrasive materials are discharged from the centrifuge.

Ring section 84 has a smooth inner surface 86 which extends upwardly and outwardly with respect to axis X—X. A ring member 38' is suitably removably and rigidly secured to the outer end of disc portion 36 which has an outer circumferential surface 88 essentially parallel to the surface 86 of ring section 84 to form a discharge opening 34' in conjunction with surface 88. When it is desired to close the discharge opening 34' during operation the actuators 48 are actuated by supplying control fluid thereto whereby the member 54' moves the upper portion of ring section 84 into engagement with the surface 88 to close the opening 34'. More specifically the upper end of member 54' engages the lower surface of the upper portion of ring section 84 to force the ring section 84 upwardly while at the same time, due to the attachment of ring section 84 and the flexibility thereof, the upper portion of ring section moves into engagement with surface 88 to close opening 34'. Since ring section 84 is deformable such engagement with surface 88 is a sealing engagement by properly controlling the pressure exerted on the ring section 84 by the upward movement of member 54'. Thus, the member 54' and the ring section 84 together form a closure member for opening 34'. Actuators 48 are deactivated by releasing the control fluid to permit the discharge opening 34' to be opened by the action of the return springs 68 of actuators 84.

Although two presently preferred embodiments have been shown and described in accordance with the Patent Statutes, it is to be realized that numerous variations in structure will achieve the same results and, accordingly, the described embodiments are merely illustrative of certain forms of the invention. In particular, FIG. 2 shows a radial discharge opening 34 with a solid closure member 54 while FIG. 3 shows a discharge opening 34' with a deformable and readily replaceable discharge opening forming ring section 84 which is actuated by the closure member 54'. If desired, the closure member 54 can be provided with a deformable member engageable with the lip 64 to provide additional sealing means responsive to the pressure exerted by the actuators 48.

The discharge opening 34', due to its angularity with respect to the axis X—X exerts a restraining force on the centrifuged material being discharged. The angle at which the discharge opening 34' extends and the width and length of the discharge opening 34' are determined by the characteristics of the centrifuged material being discharged. Inasmuch as the characteristics of all centrifuged material are not known, the range of angles for discharge opening 34' cannot be specified. Further, if desired, the angularity of the discharge opening 34' can be ninety degrees with respect to the axis X—X to provide a radial discharge controlled by a removable resilient section.

The structures described provide a centrifuge in which the discharge openings 34 and 34' are closed by external independently operable actuators 48. Thus, the characteristics of the centrifuged material or the centrifuge bowl are not relied upon to control the discharge openings 34 and 34'. Further should damage or wear to any component occur every component of the material discharge controlling mechanism is readily accessible from the exterior of the centrifuge bowl. Also, adjustments as required between operating periods of the centrifuge can readily be made since the components of the controlling mechanism are external of the centrifuge bowl. Further, since the closure member 54 has a long axial stroke, the entire controlling mechanism can be used with discharge openings 34 of various widths. Thus, the upper and lower bowl members can be axially positioned relative to each other on shaft 14 to provide various widths of discharge openings 34 as may become desirable as the nature of the incoming slurry changes without changing the material discharge controlling mechanism. Similarly various forms of ring section 84 may be provided to cooperate with various widths of opening 34' without requiring a new controlling mechanism. Further, although springs 68 are described, if desired a double actuating piston and cylinder arrangement, as is known, can be employed for the actuators 48. Also, as many actuators 48 as are required can be provided in circumferentially spaced relationship on plate 46 with the circumferential spacing being governed by the requirements of maintaining balance in rotating machinery.

Although preferred embodiments of this invention have been described in accordance with the Patent Statutes, those skilled in the art to which this invention relates will realize that various modifications can be made to the structures described without departing from the spirit and scope of the invention. Accordingly, the claims hereto are to be construed in accordance with the knowledge of one skilled in the art to which the invention relates.

What is claimed is:

1. A centrifuge comprising:

an elongated shaft member rotatable about the longitudinal central axis thereof;

a bowl member having formed sections rigidly secured to axially spaced portions of said shaft member, respectively, said formed sections extending radially outwardly of and circumferentially encompassing said central axis to form a chamber in conjunction with said shaft member, said formed sections having a discharge opening of a fixed axial configuration between radially outer peripheral portions of said formed sections for discharging a centrifuged material, means for introducing a slurry into said bowl member, said bowl member having means for discharging an effluent constituent of said slurry, a ring structure encompassing the radially outermost extent of said peripheral portions at least a portion of which includes a resilient member forming one side of the material flow path from said discharge opening, actuator means having relatively movable parts with one of said parts being secured to one of said formed sections and the other of said parts being cooperable with the resilient portion of said ring structure to displace at least a portion of said ring structure with respect to said radially outermost extent, and said actuator means being selectively and independently operable to move said other of said parts and displace at least said portion of said ring structure to selectively and independently open and close said discharge opening.

2. A centrifuge as set forth in claim 1 wherein said actuator means includes means for normally biasing said other of said parts to maintain said discharge opening in an open condition.

3. A centrifuge as set forth in claim 1 wherein said ring structure is bodily movable.

4. A centrifuge as set forth in claim 1 wherein at least one of said radially outermost extends of said peripheral portions is a cylindrical surface with the central axis thereof coincident with said axis and said ring structure has a radially inwardly facing surface slidably engageable with said cylindrical surface.

5. A centrifuge as set forth in claim 4 wherein the other of said radially outermost peripheral portions has a radially outwardly extending portion, and said ring structure having a free end engageable with said extending portion to close said discharge opening.

6. A centrifuge as set forth in claim 1 wherein said actuator means and said ring structure are external of said bowl member.

7. A centrifuge as set forth in claim 1 wherein each of said radially outermost extents is a cylindrical surface with the central axis thereof being coincident with said axis and said ring structure has a radially inwardly facing surface slidably engageable with said cylindrical surface.

* * * * *